US005987751A

United States Patent [19]

Chung

[11] Patent Number: 5,987,751

[45] Date of Patent: Nov. 23, 1999

[54] UTILITY KNIFE WITH A SAFETY LOCK

[76] Inventor: Yen-Chao Chung, 2nd Fl., No. 203-8, Chinlung Rd., Neihu Dist., Taipei, Taiwan

[21] Appl. No.: 09/203,218

[22] Filed: Nov. 30, 1998

[51] Int. Cl.[6] ..... B26B 1/08

[52] U.S. Cl. ..... 30/162; 30/332

[58] Field of Search ..... 30/162, 151, 329, 30/332, 337, 335

[56] References Cited

U.S. PATENT DOCUMENTS 5,086,562 2/1992 Jacoff ..... 30/162
5,121,544 6/1992 Gilbert ..... 30/162
5,301,428 4/1994 Wilcox ..... 30/162
5,581,890 12/1996 Schmidt ..... 30/162
5,862,596 1/1999 Chung ..... 30/162
5,864,952 2/1999 Chung ..... 30/162

*Primary Examiner*—Hwei-Siu Payer
*Attorney, Agent, or Firm*—Heller Ehrman White & McAuliffe

[57] ABSTRACT

A utility knife is provided with a feature of easy replacement of the blade and a characteristic that the utility knife body halves are prevented from separating from each other. The utility knife has a safety lock which is able to enhance the assembly between the body halves, such that even when the release mechanism of the knife is accidentally operated or the knife accidentally falls to the ground, the knife body halves are still securely attached with each other.

2 Claims, 4 Drawing Sheets

UTILITY KNIFE WITH A SAFETY LOCK

CROSS REFERENCE TO THE APPLICATION

This application is related to U.S. Pat. No. 08/871,147, filed on Jun. 9, 1997 now U.S. Pat. No. 5,862,596. The disclosure of which is hereby incorporated by reference.

BACKGROUND OF THE INVENTION

1. Field of the Invention

The present invention relates to a utility knife, in particular, an improved utility knife with a safety lock, with which a user is able to securely lock an outer body of the knife without worrying that the utility knife may fall apart when an external force is accidentally exerted thereon.

2. Description of Related Art

A conventional utility knife for woodworking is shown in FIG. 5. A utility knife of this kind has a retainer (30) pivotally received between an upper cover (10) and slide (40) movably received in a lower cover (20) which is detachably connected with the upper cover (10). The retainer (30) has a through hole (31) defined in the end thereof and the slide (40) has a wedge (41) detachably extending through the through hole (31), such that when the retainer (40) is pushed in a direction toward the lower cover (20), the slide (40) will first be forced to slide away by the insertion of the retainer (30) and then the slide (40) will return and insert into the through hole (31) of the retainer (30) due to the force of a recoil spring (21). When the upper cover (10) is to be disassembled from the lower cover (20), a user only needs to push the slide (40) along the lower cover (20) to force the wedge (41) to separate from the through hole (31) of the retainer (30). Because the retainer (30) is pivotally in connection with the upper cover (10), the upper cover (10) and the lower cover (20) are easily assembled and disassembled. When the upper and lower covers (10, 20) are assembled, the only force applied therebetween is the securing force between the retainer (30) and the slide (40). Therefore, it is still quite easy to separate the upper cover (10) and the lower cover (20), especially when an external force is accidentally applied, e.g. the knife accidentally falls on the ground. The blade (51) is held by a carrier (52) which is movably received between the upper cover (10) and the lower cover (20). Once the upper cover (10) and the lower cover (20) are separated with each other, the blade (51) may come out and hurt someone nearby.

In order to mitigate and/or obviate the above disadvantages, the invention provides an improved utility knife having a safety lock to strengthen the connection between the upper cover and the lower cover.

SUMMARY OF THE INVENTION

The main object of the invention is to provide a safety lock movably mounted on the slide to further strengthen the assembly of the knife so that the utility knife will not fall apart even when an external force is accidentally applied.

DETAILED DESCRIPTION OF PREFERRED EMBODIMENT

Figure 1:
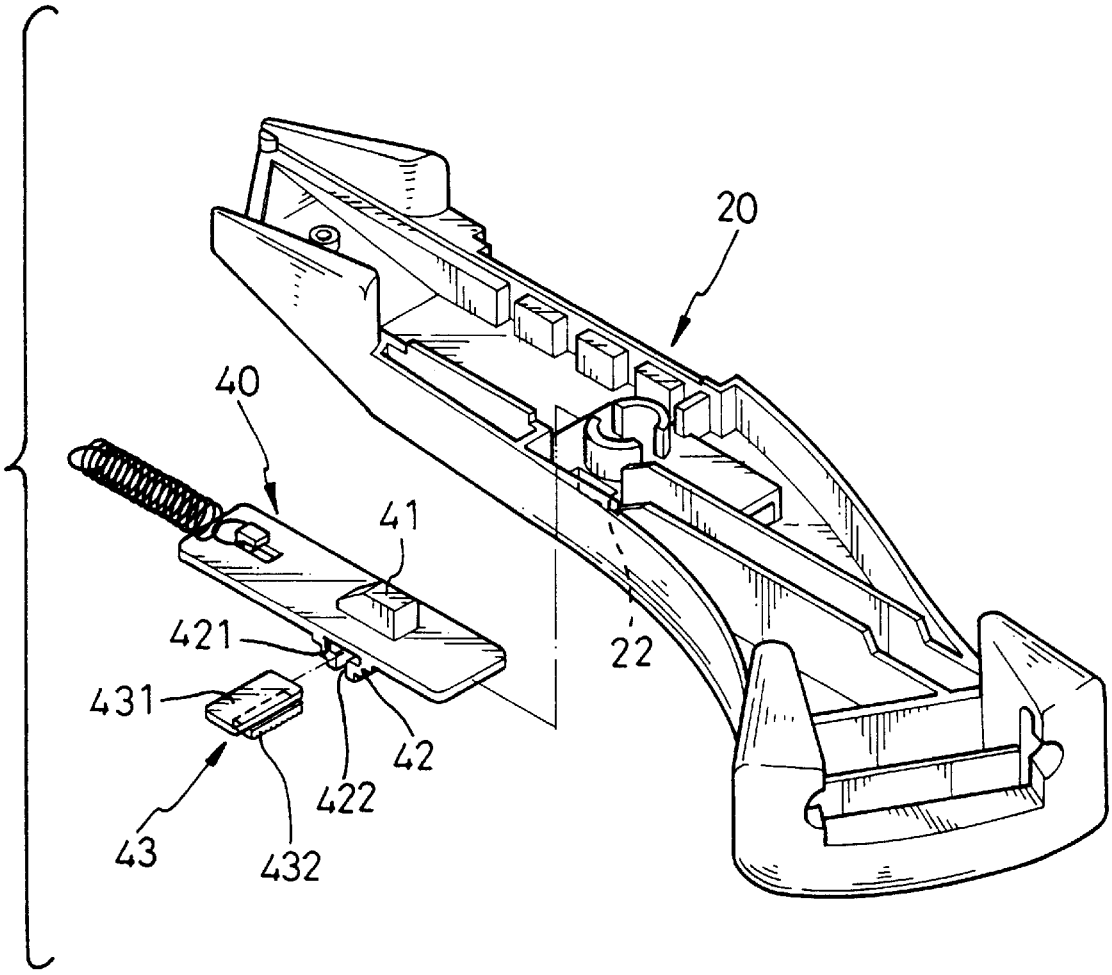
FIG. 1 is an exploded perspective view showing a partial components of a utility knife in accordance with the present invention.

In FIG. 1 shows the improvements of a utility knife. The utility knife has basically the same components as described in conventional utility knives, except for a minor difference in the lower cover (20). Therefore, the same reference numerals are used when referring to equivalent components.

As with the conventional utility knife, the slide (40) is movable in relation to the lower cover (20), and because of the recoil spring (21), the slide (40) is able to return to its original position once the slide (40) is moved by a user. The slide (40) has a receptacle (42) formed in a surface opposite to a surface having the wedge (41) formed thereon. The receptacle (42) defines therein a channel (421) so as to movably receive therein a lock (43). Furthermore, the receptacle (42) has a slit (422) defined to communicate with the channel (421). The lock (43) is designed to have a base (431) and a tongue (432) integrally formed with the base (431) and having a width smaller than that of the base (431). The tongue (432) and the base (431) are formed so that the base (431) is able to be received in the channel (421), and the tongue (432) extends through the slit (422) and remains outside of the receptacle (42). The lower cover (20) has a hole (22) defined to releasably receive the base (431) of the lock (43) therein.

Figure 2:
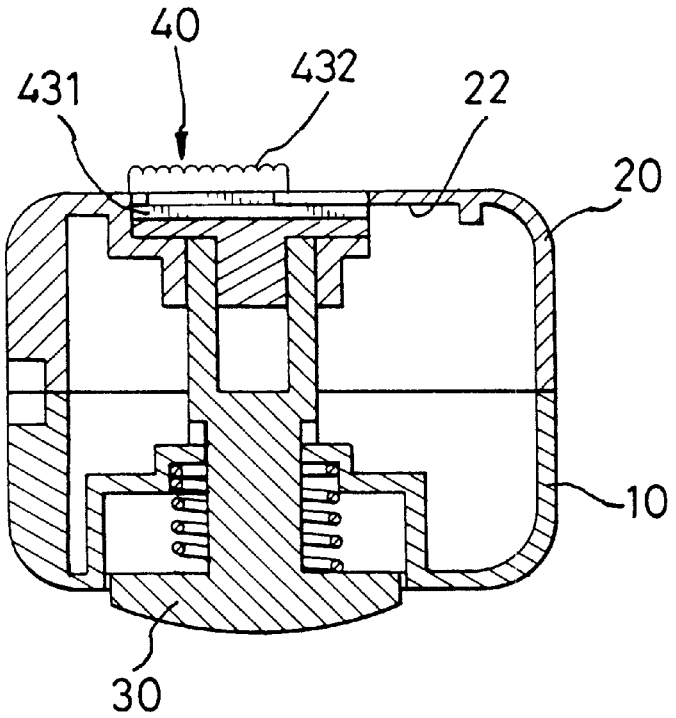
FIG. 2 is a schematic cross sectional view of the present invention.
Figure 3:
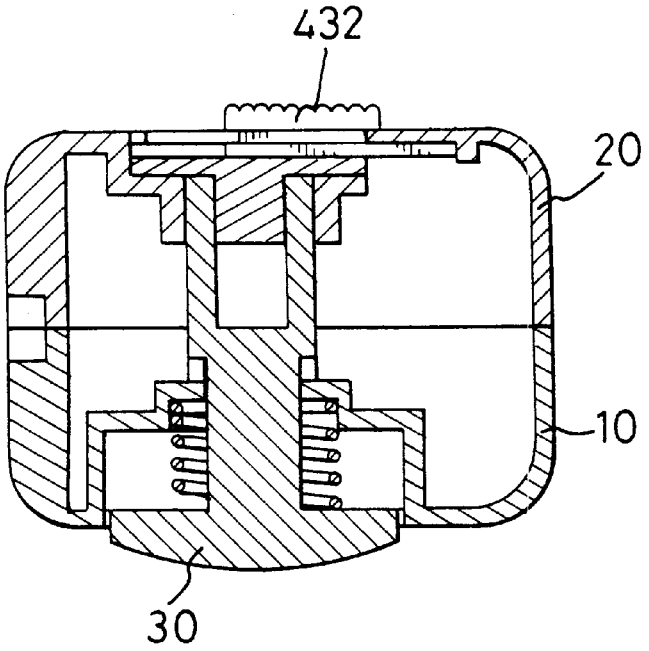
FIG. 3 is a schematic cross sectional view showing the operation of the safety lock.

Referring to FIG. 2, after the utility knife of the invention is assembled, the tongue (432) remains outside of the receptacle (42), and the base (431) is received in the receptacle (42). When the tongue (432) is pushed by a user, the base (431) moves into the hole (22) so that the movable relation of the slide (40) to the lower cover (20) is inhibited, as shown in FIG. 3. When the slide (40) is securely fixed in relation to the lower cover (20), the retainer (30) will no longer have the pivotal movement with respect to the upper cover (10) and therefore, the assembly between the upper cover (10) and the lower cover (20) is enhanced.

Figure 4:
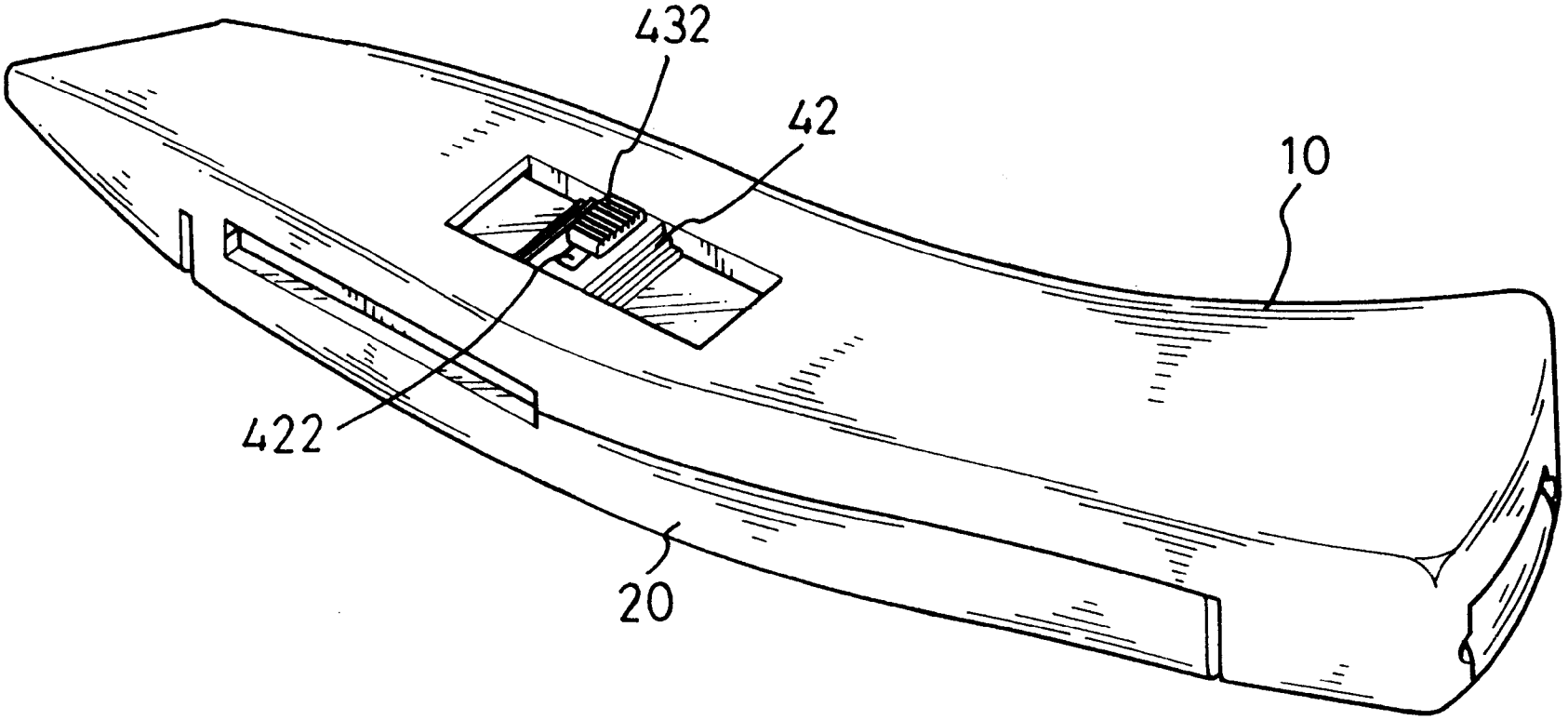
FIG. 4 is a perspective view showing the utility knife in accordance with the present invention.
Figure 5:
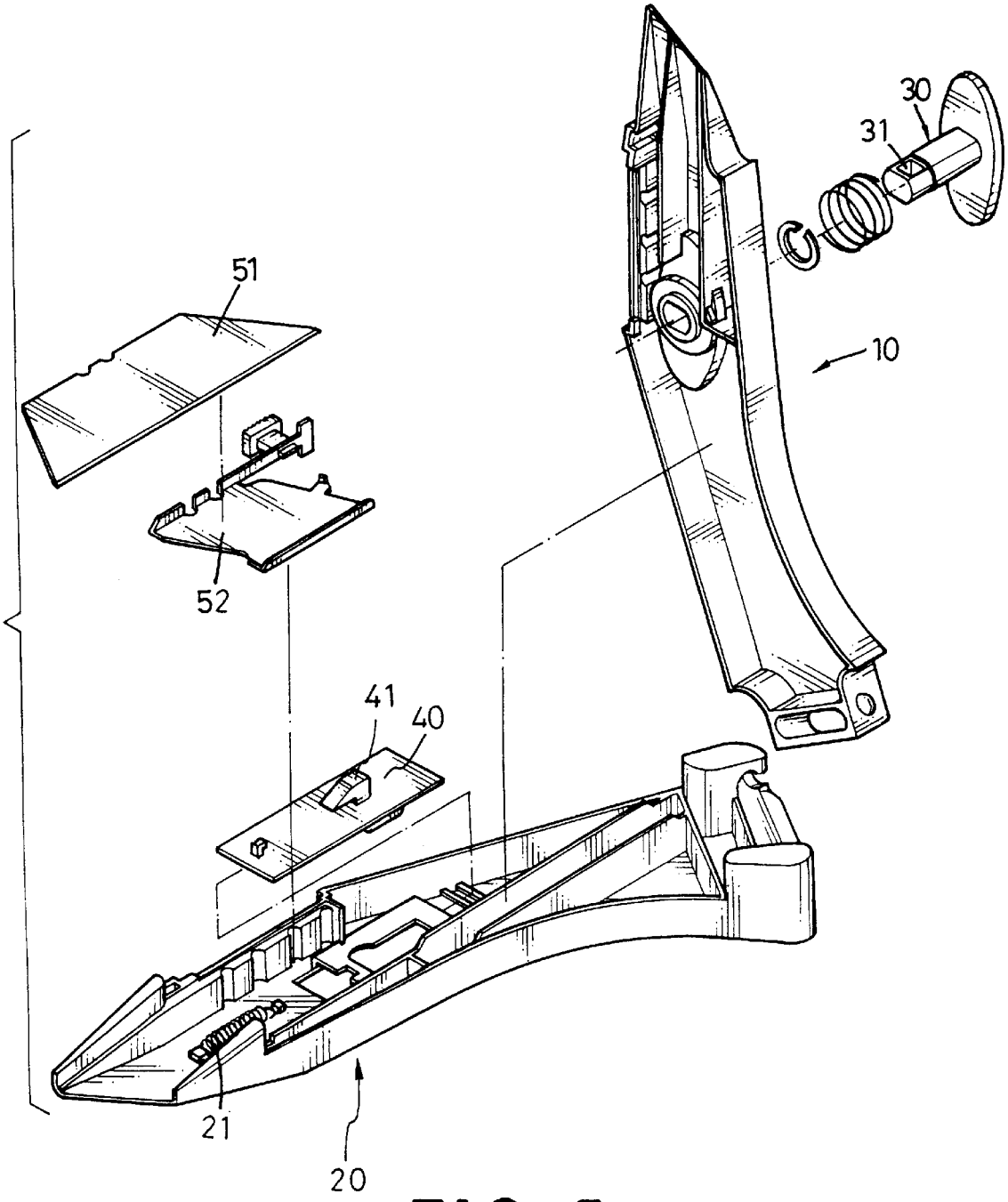
FIG. 5 PRIOR ART
FIG. 5 is an exploded view showing components of a conventional utility knife.

FIG. 4 shows the appearance of the utility knife of the invention. It is noted that the tongue (432) is movable outside of the receptacle (42) and the base (431) is movable inside of the receptacle (42).

What claimed is:

1. A utility knife with a safety lock comprising an upper cover, a lower cover detachably connected with the upper cover, a retainer pivotally received in relation to the upper cover, a slide movably received with respect to the lower cover and having a wedge formed thereon to be detachably connected with the retainer, wherein the improvements comprise:

a receptacle is formed in a surface of said slide opposite to a surface having the wedge formed thereon and defines therein a channel and a slit in communication with the channel;

a lock is designed to have a base movable in the channel and a tongue integrally formed with the base and extending through the slit and remaining outside of the receptacle; and the lower cover has a hole defined to releasably receive the base of the lock therein.

2. The knife as claimed in claim 1, wherein the tongue has a width smaller than that of the base.

* * * * *